US006732708B2

(12) United States Patent
Nishizawa et al.

(10) Patent No.: US 6,732,708 B2
(45) Date of Patent: May 11, 2004

(54) AUTOMOTIVE ENGINE CONTROL APPARATUS

(75) Inventors: Osamu Nishizawa, Tokyo (JP); Tetsushi Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 124 days.

(21) Appl. No.: 10/036,529

(22) Filed: Jan. 7, 2002

(65) Prior Publication Data

US 2003/0015174 A1 Jan. 23, 2003

(30) Foreign Application Priority Data

Jul. 23, 2001 (JP) ..... 2001-221587

(51) Int. Cl.[7] ..... F02P 5/00

(52) U.S. Cl. ..... 123/406.13; 123/406.45; 123/406.46; 123/406.47; 123/479

(58) Field of Search ..... 123/406.11, 406.12, 123/406.13, 406.15, 406.16, 406.45, 406.46, 406.47, 479

(56) References Cited

U.S. PATENT DOCUMENTS

| | | | | |
|---|---|---|---|---|
| 5,579,743 A | * | 12/1996 | Kadowaki | 123/568.24 |
| 5,596,253 A | * | 1/1997 | Mizuta et al. | 318/469 |
| 6,044,823 A | | 4/2000 | Watanabe | |
| 6,244,061 B1 | * | 6/2001 | Takagi et al. | 62/229 |
| 6,580,188 B2 | * | 6/2003 | Katagiri et al. | 310/67 A |

FOREIGN PATENT DOCUMENTS

| | | |
|---|---|---|
| JP | 62-290111 | 12/1987 |
| JP | 7-109969 | 4/1995 |
| JP | 9-112735 | 5/1997 |
| JP | 10-257799 | 9/1998 |
| JP | 10-318025 | 12/1998 |
| JP | 2000-380652 | 12/2000 |
| JP | 2001-65445 | 3/2001 |
| JP | 2001-213738 | 7/2001 |

* cited by examiner

*Primary Examiner*—John Kwon
(74) *Attorney, Agent, or Firm*—Sughrue Mion, PLLC

(57) ABSTRACT

In an automotive engine control apparatus used for a multi-cylinder engine where both an injection coil and an ignition coil are employed with each of multiple cylinders, abnormal states are systematically detected, while an injection system is mutually interconnected with an ignition system as to these abnormal states. The injection coils are driven via a first switch element by a microprocessor, and injection operations of these injection coils are monitored by a first detection circuit. The ignition primary coils are driven via a second switch element by the microprocessor, and ignition operations of these ignition coils are monitored by a second detection circuit. The microprocessor controls drive stopping means to perform a turn-out drive operation such that this drive stopping means stops both a fuel injection operation and an ignition operation of an abnormal-operated cylinder with respect to an abnormal state occurred in either the injection system or the ignition system. Also, abnormal-state storage operation by abnormal state storage means separatedly provided for the injection system/ignition system/cylinder system, which is derived from stopping of the drive operations, is prohibited by storage prohibiting means.

7 Claims, 9 Drawing Sheets

| | FIRST CYLINDER | SECOND CYLINDER | THIRDCYLINDER | FOURTH CYLINDER |
|---|---|---|---|---|
| INJECTION COIL | 4a | 4b | 4c | 4d |
| IGNITION COIL | 5a | 5b | 5c | 5d |
| FIRST TIME INSTANT | COMPRESSION | EXPANSION | AIR-INTAKE | EXHAUST |
| SECOND TIME INSTANT | EXPANSION | EXHAUST | COMPRESSION | AIR-INTAKE |
| THIRD TIME INSTANT | EXHAUST | AIR-INTAKE | EXPANSION | COMPRESSION |
| FOURTH TIME INSTANT | AIR-INTAKE | COMPRESSION | EXHAUST | EXPANSION |

AUTOMOTIVE ENGINE CONTROL APPARATUS

BACKGROUND OF THE INVENTION

1. Field of the Invention

The present invention is related to an automotive engine control apparatus. More specifically, the present invention is directed to an automotive engine control apparatus capable of controlling both injection coils for driving of fuel-injecting electromagnetic valves and ignition coils with respect to injected fuel, while the fuel-injecting electromagnetic valves are provided in correspondence with the respective cylinders of an automotive multi-cylinder engine.

2. Description of the Related Art

Conventionally, as to electromagnetic coils such as injection coils capable of driving fuel-injecting electromagnetic valves and ignition coils capable of igniting injected fuel, both voltages and currents appeared in the respective circuit portions of coil drive circuits are monitored to detect disconnection/shortcircuit malfunction with respect to electromagnetic coils, wiring lines, and switch elements and the like. Furthermore, such a method of detecting a malfunction is known in this field, by which malfunction detection signals with respect to loads in multi-channels are OR-gated with each other to simplify signal processing operation.

Japanese Patent Laid-open No. 10-257799 discloses "AN OUTPUT-OPEN DETECTING APPARATUS OF A MULTI-CHANNEL OUTPUT APPARATUS." This output-open detecting apparatus detects disconnections by utilizing such a fact that while a very small current is supplied to a multi-channel load, for example, an energizing coil of a stepping motor when the multi-channel load is not driven, if a disconnection occurs in this multi-channel load circuit, voltages at the opposing ends of the load are increased. Although this output-open detecting apparatus does not disclose detections of shortcircuited loads, this detecting apparatus discloses a method in which the disconnection detection signals are OR-gated by the diode OR-gate circuit, and the OR-gated signal is supplied to the commonly-used comparing/judging circuit.

In contrast, Japanese Patent Publication No. 7-92016 discloses "A MALFUNCTION DETECTION CIRCUIT OF A FUEL INJECTING VALVE DRIVING CIRCUIT FOR INTERNAL COMBUSTION ENGINE." This malfunction detection circuit detects a surge voltage which is generated when a supply of a current to a fuel-injecting-valve driving electromagnetic coil is interrupted, so that this malfunction detection circuit can detect disconnection/shortcircuit malfunction of electromagnetic coils/wiring lines/switch elements and the like in a batch manner.

Also, Japanese Patent Laid-open No. 9-112735 discloses "AN ELECTROMAGNETIC VALVE DRIVING APPARATUS." In a method according to this invention, for example, as to a driving electromagnetic coil for a fuel-injecting electromagnetic valve, both a quick-driving voltage boosting circuit and an operation holding low current circuit are employed. Further, the disconnections and shortcircuits of the plural electromagnetic coils and also the wiring lines thereof are detected by monitoring the charging voltage and the discharging voltage of the capacitor employed in the voltage boosting circuit. In particular, in this prior art, there is shown a method in which a plurality of fuel-injecting-valve driving electromagnetic coils are grouped, and thus the turn-out drive operation can be carried out in a smooth manner based upon the malfunction judgment result.

Further, Japanese Patent Laid-open No. 10-318025 discloses "A CONTROL APPARATUS FOR A FUEL-INJECTING INJECTOR." In this control apparatus, a plurality of injector coils are controlled to be turned ON/OFF, while one ends of these injector coils are connected to the commonly-used drive output circuit, and the other ends of these injector coils are connected to the separate switching means which are turned ON/OFF at the energizing timing for the respective injector coils. These plural injector coils are designed such that the fuel injection sequences thereof are separated from each other by approximately two strokes or more, and furthermore, the energizing timing thereof is not overlapped with each other.

On the other hand, "A COMBUSTION CONDITION DETECTING APPARATUS OF INTERNAL COMBUSTION ENGINE" of Japanese Patent Laid-open No. 2001-65445 discloses such a conceptional idea that an ignition ion current generated in a cylinder is detected to judge whether or not an abnormal state occurs in an ignition system.

Furthermore, Japanese Patent Laid-open No. 7-109969 discloses "AN IGNITION APPARATUS FOR MULTI-CYLINDER TYPE INTERNAL COMBUSTION ENGINE." According to an ignition apparatus of this invention, there is shown a method in which misfire detection circuits are provided on the respective primary coil sides of plural ignition coils and the operations of all of these ignition coils are stopped so as to stop the engine when an abnormal state occurs in some of these ignition coils.

Also, Japanese Patent Laid-open No. 12-380652 discloses "AN ABNORMAL STATE DETECTING APPARATUS OF AN ON-VEHICLE ELECTRIC LOAD DRIVING SYSTEM." According to an abnormal state detecting apparatus of this invention, there is shown a method in which an abnormal state detection signal which has been OR-gated is detected in a separation manner within a microprocessor.

As previously described, the various types of conventional abnormal state detecting methods have been proposed with respect to the disconnections/shortcircuits of the electric loads such as various sorts of electromagnetic coils, and further, as to the disconnections/shortcircuits of the switch control elements used for these electromagnetic coils and wiring lines. However, these prior art systems do not constitute a means capable of mutually combining a fuel injection system with an ignition coil system, and thus capable of systematically judging whether or not an abnormal state occurs in both these systems. Instead, since the turn-out drive operation is carried out based upon the abnormal state judgment result as to any one of these fuel injection system and ignition coil system in these prior art systems, there are the following problems. That is, while the turn-out drive operation is performed, non-combustion gas may be exhausted, and electric energy may be uselessly consumed, so that the turn-out drive operation cannot be carried out under the stable condition.

SUMMARY OF THE INVENTION

The present invention has been made to solve the above-described problems, and an object of the present invention is threrfore to provide an automotive engine control apparatus capable of performing a turn-out drive operation under the stable condition based upon abnormal state judgment results of both a fuel injection system and an ignition coil system.

To achieve the above-described object, according to an aspect of the present invention, there is provided an automotive engine control apparatus for controlling an automotive engine equipped with injection coils capable of driving fuel injection electromagnetic valves with respect to the respective cylinders of a multi-cylinder engine, and ignition apparatus provided with the respective cylinders, for performing ignition operations with respect to injected fuel; comprising: control means for controlling an internal operation of the automotive engine control apparatus; a first switch element for sequentially driving the respective injection coils in response to a pulse series of an ignition drive signal generated by the control means; a first detection circuit for detecting that at least the injection coils are turned ON/OFF; first abnormal state judging means for comparing a detection signal derived from the first detection circuit with the injection drive signal to judge whether or not said injection coils are operated under normal state with respect to each of the cylinders; first abnormal state storage means for storing thereinto a judgment result obtained by the first abnormal state judging means with respect to each of the cylinders; a second switch element for sequentially driving the respective ignition apparatus in response to a pulse series of an ignition drive signal generated by the control means; a second detection circuit for detecting that at least the respective ignition apparatus are turned ON/OFF; second abnormal state judging means for comparing a detection signal derived from the second detection circuit with the ignition drive signal to judge whether or not the ignition apparatus is operated under the normal state with respect to each of the cylinders; second abnormal state storage means for storing thereinto a judgment result obtained by the second abnormal state judging means with respect to each of the cylinders; drive stopping means for stopping both the fuel injection operation and the ignition drive operation as to a cylinder operated under the abnormal state, which is stored into any one of the first and second abnormal state storage means; and storage prohibiting means operated in such a manner that when any one of the first and second abnormal state storage means stores thereinto the judgment result of the cylinder operated under the abnormal state, the other of the first and second abnormal state storage means is prohibited from storing thereinto the judgment result.

Also, according to another aspect of the present invention, there is provided an automotive engine control apparatus for controlling an automotive engine equipped with injection coils capable of driving fuel injection electromagnetic valves with respect to the respective cylinders of a multi-cylinder engine, and ignition apparatus provided with the respective cylinders, for performing ignition operations with respect to injected fuel, in which: each of the cylinders composes a cylinder group in conjunction with another cylinder thereof, the injection timing of which is separated by even-numbered timing from the injection timing of the first-mentioned cylinder; and the automotive engine control apparatus is comprised of: control means for controlling an internal operation of the automotive engine control apparatus; a first switch element for sequentially driving the respective injection coils in response to a pulse series of an ignition drive signal generated by the control means; a first detection circuit for detecting that at least the injection coils are turned ON/OFF; first abnormal state judging means for comparing a detection signal derived from the first detection circuit with the injection drive signal to judge whether or not said injection coils are operated under the normal state with respect to each of the cylinders; first abnormal state storage means for storing thereinto a judgment result obtained by the first abnormal state judging means with respect to each of the cylinders; a second switch element for sequentially driving the respective ignition apparatus in response to a pulse series of an ignition drive signal generated by the control means; a second detection circuit for detecting that at least the respective ignition apparatus are turned ON/OFF; second abnormal state judging means for comparing a detection signal derived from the second detection circuit with the ignition drive signal judge whether or not the ignition apparatus is operated under the normal state with respect to each of the cylinders; second abnormal state storage means for storing thereinto a judgment result obtained by the second abnormal state judging means with respect to each of the cylinders; and cylinder group drive stopping means for stopping both fuel injection operations and ignition drive operations related to a cylinder operated under the abnormal state which is stored into any one of the first and second abnormal state storage means, and also related to all of other cylinders which compose a cylinder group in conjunction with the cylinder operated under the abnormal state.

Also, the automotive engine control apparatus further comprises recovery means for causing both the fuel injection operation and the ignition drive operation to become active with respect to a cylinder whose information is not stored in the first and second abnormal state storage means in the case where the drive operations of plural cylinder groups are stopped by the cylinder group drive stopping means.

Also, the automotive engine control apparatus further comprises: interconnection storage prohibiting means which prohibits, in the case where any one of the first and second abnormal state storage means stores thereinto the judgment result of the cylinder operated under the abnormal state, such operations that the other of the first and second abnormal state storage means stores thereinto the judgment result, and also prohibits judgment results related to all of other cylinders which compose a cylinder group in conjunction with the cylinder operated under the abnormal state from being stored into both the first and second abnormal state storage means.

Also, the first detection circuit is an off-surge voltage detection circuit used for the first switch element provided with respect to the injection coils; and the detection signal is supplied to the control means via an OR-gate circuit employed between the off-surge voltage detection circuit and the control means.

Also, the ignition apparatus includes an ignition primary coil; the second detection circuit is an off-surge voltage detection circuit for detecting a current interrupt of the ignition primary coil; and the detection signal is supplied to the control means via an OR-gate circuit provided between the off-surge voltage detection circuit and the control means.

Also, the ignition apparatus includes an ignition secondary coil; the second detection circuit is a discharge current detection circuit for detecting a discharge current of the ignition secondary coil; and the detection signal is supplied to the control means via an OR-gate circuit provided between the off-surge voltage detection circuit and the control means.

Also, the automotive engine control apparatus further comprises a warning/display apparatus for notifying the abnormal state in the case where any one of the first abnormal state storage means and the second abnormal state storage means stores thereinto the judgment result of the cylinder operated under the abnormal state.

Also, the automotive engine control apparatus further comprises warning/display synthesizing means for issuing such a notification that the abnormal state occurred in an injection system/ignition system/cylinder system is not discriminated from each other in the case where any one of the first and second abnormal state storage means stores thereinto the judgment result of the cylinder operated under the abnormal state; and the warning/display apparatus is operated in response to a signal supplied from the warning/display synthesizing means.

Also, the automotive engine control apparatus further comprises a communication interface circuit for communicating with a predetermined external tool provided outside of the automotive engine control apparatus; display/transmission means for transmitting/displaying malfunction information to/on the external tool; and reset means for initializing the storage contents of the first and second abnormal state storage means by means of the external tool.

BRIEF DESCRIPTION OF THE DRAWINGS

For a better understanding of the present invention, reference is made of a detailed description in conjunction with the accompanying drawings, in which.

DETAILED DESCRIPTION OF THE PREFERRED EMBODIMENTS

First Embodiment

Figure 1:
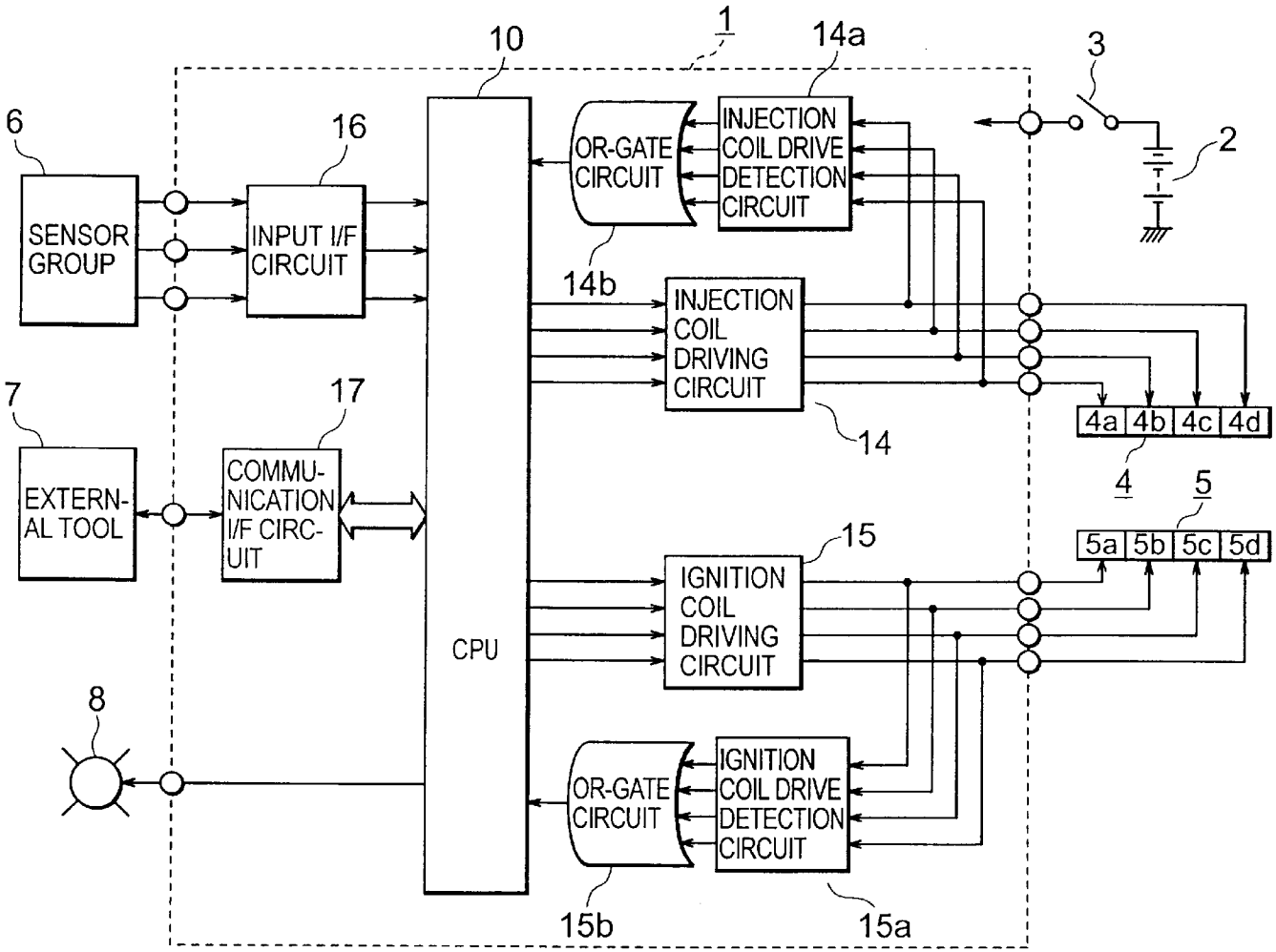
FIG. 1 is a structural diagram for schematically showing an automotive engine control apparatus according to a first embodiment of the present invention, and a peripheral construction of an internal combustion engine.

FIG. 1 schematically represents an example of a construction of an internal combustion engine on which an automotive engine control apparatus according to a first embodiment of the present invention is mounted. In FIG. 1, reference numeral 1 shows an automotive engine control apparatus which is mainly arranged by a microprocessor (CPU) 10 described-below and also reference numeral 2 shows an automotive battery used to supply electric power to this automotive engine control apparatus 1. Reference numeral 3 represents a power supply switch 3 which is provided between the automotive engine control apparatus 1 and the automotive battery 2, and switches-ON/OFF the supply of electric power to the automotive engine 2.

Also, reference numeral 4 shows a fuel-injecting electromagnetic valve which is provided with respect to each of cylinders of a multi-cylinder type automotive engine (not shown), and more specifically, reference numerals 4*a*, 4*b*, 4*c*, and 4*d* indicate injection coils which are provided in correspondence with a first cylinder through a fourth cylinder, respectively, and drive this electromagnetic valve 4. Reference numeral 5 represents an ignition apparatus which is employed in correspondence with each of these cylinders of the multi-cylinder type automotive engine (not shown), and more specifically, reference numerals 5*a*, 5*b*, 5*c*, and 5*d* are ignition primary coils which correspond to the first cylinder through the fourth cylinder, respectively, and constitute this ignition apparatus 5. The above-described injection coils 4*a* to 4*d*, and also the above-explained ignition primary coils 5*a* to 5*d* are connected to output terminals of the above-described automotive engine control apparatus 1.

Also, reference numeral 6 indicates a sensor group constructed of a crank angle sensor, a cam angle sensor, a throttle open-degree sensor, and the like. This sensor group 6 is used to determine fuel injection timing, an injection amount (injection time period), ignition timing with respect to injected fuel, and so on. An input signal from the sensor group 6 is connected to an input terminal of the automotive engine control apparatus 1. Reference number 7 shows an external tool which is used to write a control program with respect to the microprocessor 10, and also, reads and displays a storage content of a data memory (not shown). This external tool 7 is detachably connected to the input terminal of the automotive engine control apparatus 1. Reference numeral 8 shows a warning/display apparatus which issues a warning notice and/or displays (by display apparatus) to notify an abnormal state derived from the microprocessor 10. This warning/display apparatus 8 is connected to an output terminal of the automotive engine control apparatus 1, and is installed at a place where a vehicle driver may easily recognize a displayed content of this warning/display apparatus 8.

Also, reference numeral 14 shows a first switch element (first open/close element) which constitutes an injection coil drive circuit for supplying operation holding currents to the injection coils 4*a* to 4*d* to drive. This first switch element 14 is provided as an internal structure of the automotive engine control apparatus 1, and may be turned ON/OFF in response to a control output of the above-described microprocessor 10. Also, reference numeral 14*a* indicates a first detection circuit which constitutes an injection coil drive detection circuit for monitoring operations of the injection coils 4*a* to 4*d*. A detection output of this first detection circuit 14*a* is connected via an OR-gate circuit 14*b* to an input terminal of the microprocessor 10. The first detection circuit 14*a* is constituted by, for example, an off-surge voltage detection circuit with respect to the first switch element.

Also, reference numeral 15 shows a second switch element (second open/close element) which constitutes an ignition coil drive circuit for supplying operation holding currents to the ignition primary coils 5*a* to 5*d* to drive. This second switch element 15 may be turned ON/OFF in response to a control output of the microprocessor 10. Also reference numeral 15*a* indicates a second detection circuit which constitutes an ignition coil drive detection circuit for monitoring operations of the ignition primary coils 5*a* to 5*d*. A detection output of this second detection circuit 15*a* is connected via an OR-gate circuit 15*b* to an input terminal of the microprocessor 10. The second detection circuit 15*a* is constituted by, for example, an off-surge voltage detection circuit with respect to the current interruptions of the ignition primary coils 5*a* to 5*d* which constitute the ignition apparatus 5. As a result, since such a simple off-surge detection circuit is employed, this off-surge detection circuit can detect not only shortcircuits, disconnections, and releases of load coils, switch elements thereof, wiring lines thereof, and the like in a batch manner, but also can reduce the number of input signals with respect to the microprocessor 10.

Further, reference numeral 16 indicates an input interface circuit provided between the sensor group 6 and the microprocessor 10, and reference numeral 17 represents a communication interface circuit provided between the external tool 7 and the microprocessor 10.

Although not shown in FIG. 1, a RAM memory is provided in the microprocessor 10. This RAM memory is employed in order to store into each of the cylinders abnormal states (e.g. malfunction information) of ignition coils and injection coils in correspondence with each of them. Since a storage prohibiting means described-below is employed, the storage operations of this RAM memory are determined as follows: in the case that an abnormal state happens to occur in any one of the ignition system and the injection system, only malfunction information as to such a system where this abnormal state happens to occur is stored into this RAM memory, while such information as to another system whose operation is interconnectedly stopped in conjunction with the operations of system under malfunction state is constituted not to store into this RAM memory.

Figure 2A:
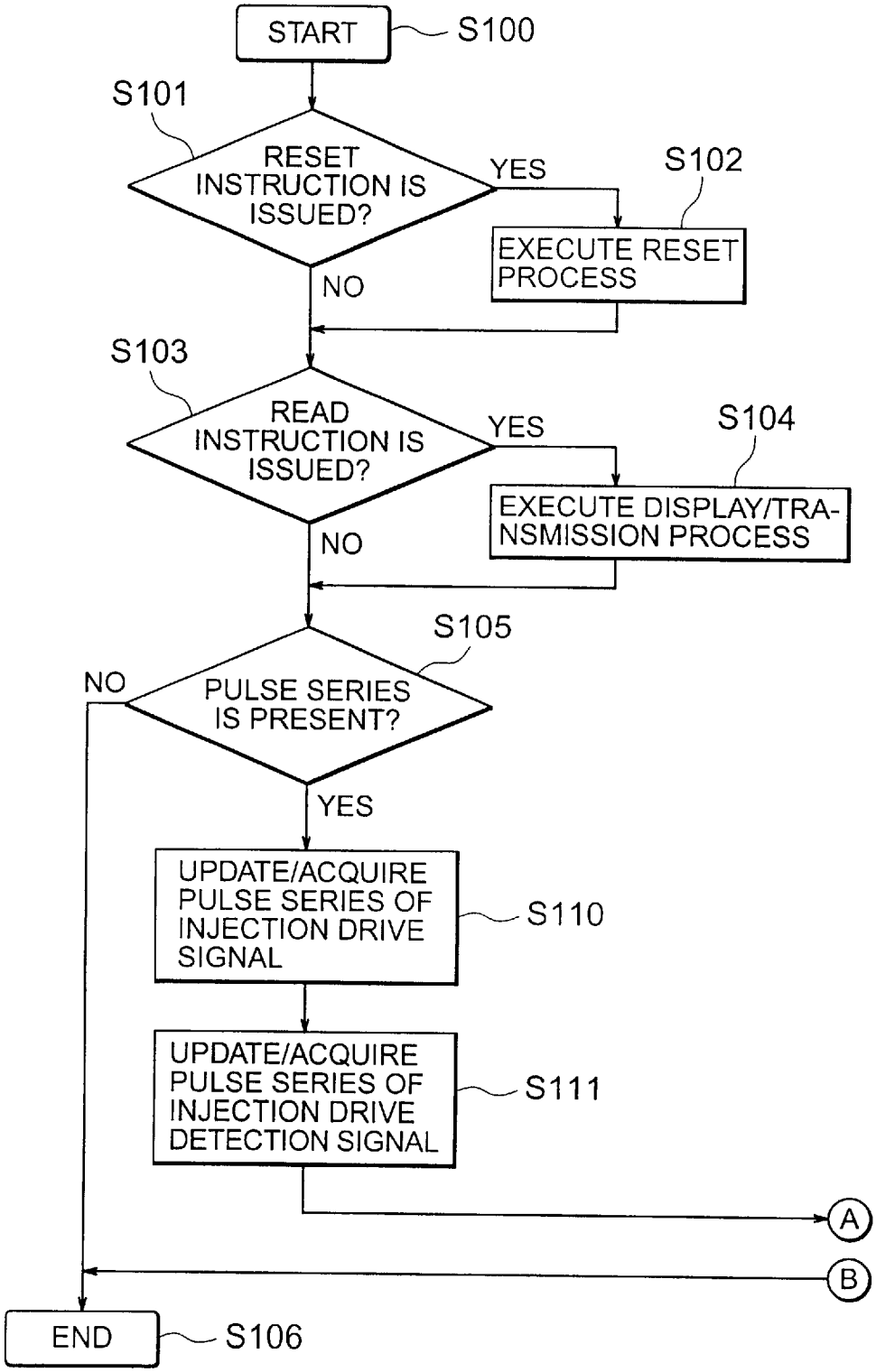
FIGS. 2A, 2B, 2C are flow charts for explaining operations of the automotive engine control apparatus shown in FIG. 1.
Figure 2B:
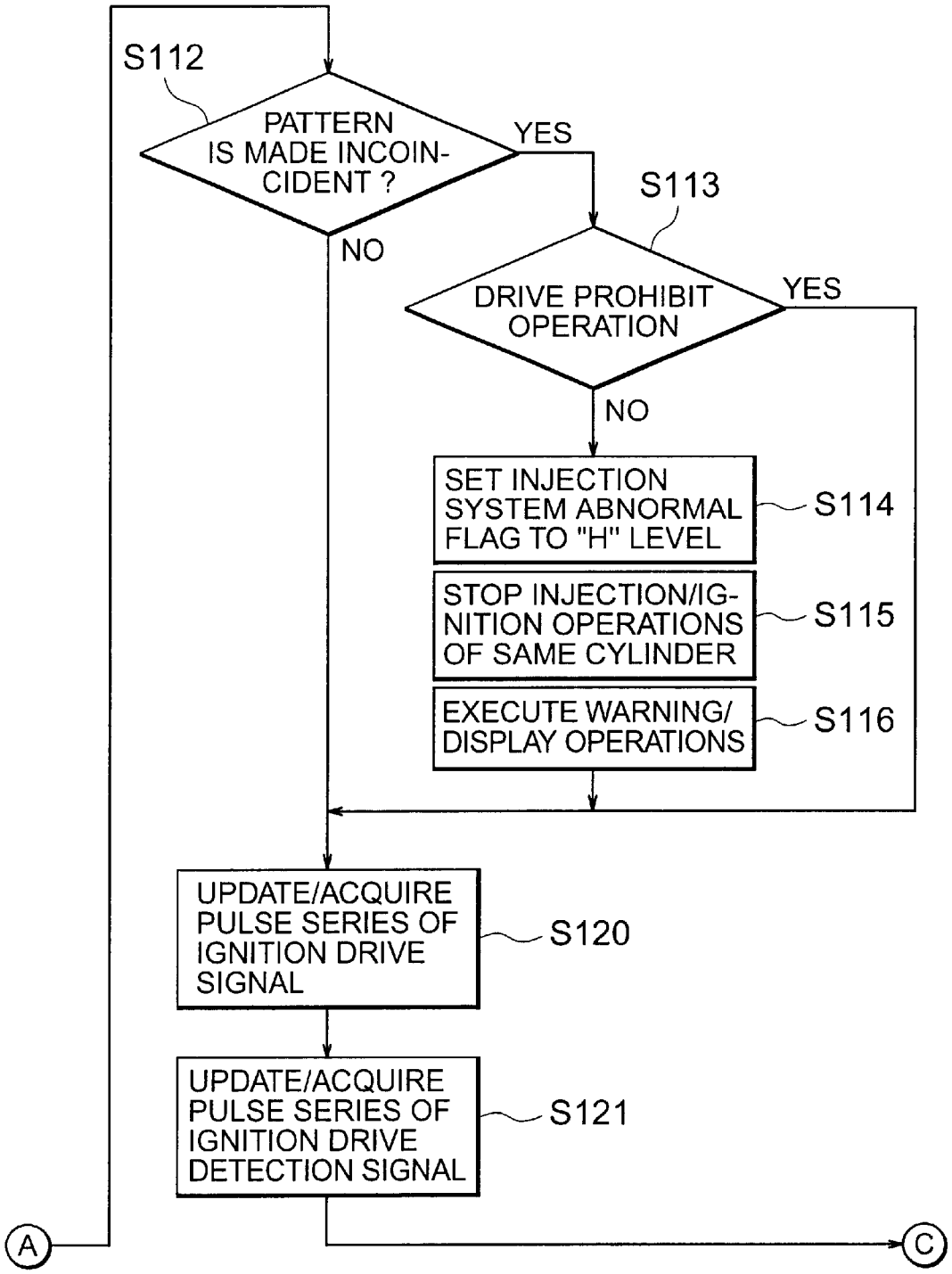
Figure 2C:
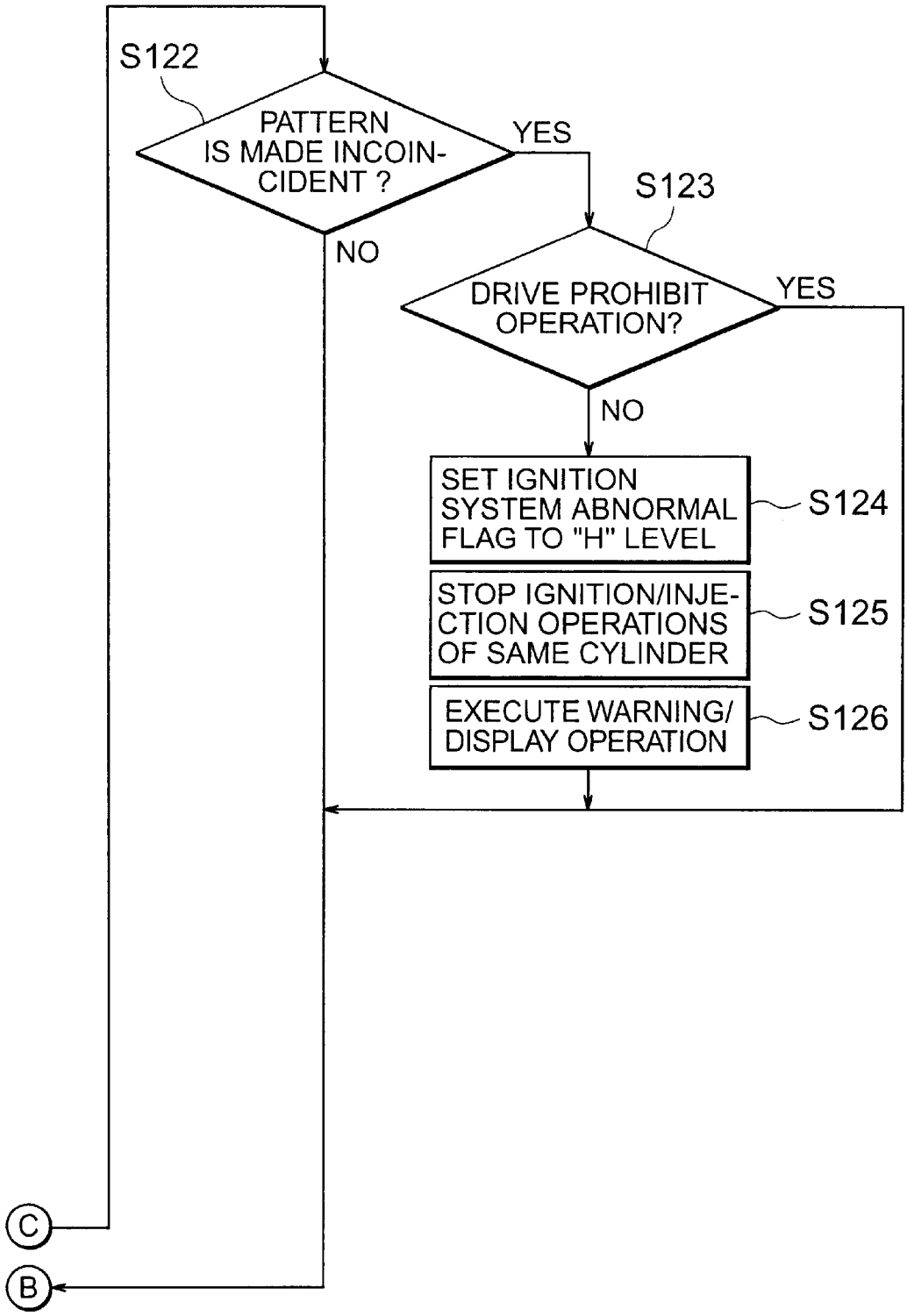

Next, operations of the automotive engine control apparatus according to this first embodiment will now be explained. FIG. 2 is a flow chart for describing the operations of the arrangement shown in FIG. 1. In FIG. 2, when the operation of this automotive engine control apparatus 1 is commenced (step S100), the microprocessor 10 judges as to whether or not a reset instruction is issued from the external tool 7 (step S101). In the case that the microprocessor 10 judges that the reset instruction is issued at the judging step S101 (namely, in case of "YES"), malfunction information stored in the RAM memory employed in the microprocessor 10 is set by a reset means at a step S102, and thereafter, the process operation is advanced to a step S103. On the other hand, in the case that the microprocessor 10 judges that no reset instruction is issued at the step S101 (namely, in case of "NO"), the process operation is directly advanced to the step S103. In other words, the step S103 corresponds to such a step for judging as to whether or not a read instruction is issued from the external tool 7. The process operation defined at this step S101 is carried out in the case that the operation defined at this step S102 is ended, or in the case that the microprocessor 10 judges that no reset instruction is issued at the judging step S103 (namely, in case of "NO") and then, the external tool 7 is not connected, or even when the external tool 7 is connected, no reset instruction is issued. When the judgment result becomes "YES" at this judging step S103, the malfunction information stored in the RAM memory employed in the microprocessor 10 is transmitted to the external tool 7 (display/transmission means) at a step S104. In such a case that the process operation defined at this step S104 is accomplished, in the case that the judgment result of the step S103 is "NO" and the external tool 7 is not connected, or in the case that even if the external tool 7 is connected, no read instruction is issued, the process operation is advanced to a further step S105. At this step S105, a check is made as to whether or not the microprocessor 10 produces a fuel injection controlling output pulse. In the case that the judgment result of this step S105 is "NO" and the fuel injection is not carried out, the process operation is advanced to an end step S106, and then is again returned to the starting step S100.

In the case that the judgment result of the above-explained step S105 is "YES", the microprocessor 10 sequentially updates and stores such information that the drive signals with respect to the injection coils 4*a* to 4*d* are turned ON/OFF into the RAM memory at a step S110 (injection coil drive signal acquiring means). Next, at a step S111, the microprocessor 10 sequentially updates and stores such information that the injection coils 4*a* to 4*b* are energized and/or deenergized so as to be ON/OFF-driven into the RAM memory (injection coil operation signal acquiring means). Next, at a step S112, the microprocessor 10 compares the drive signal acquired at the above step S110 with the operation signal acquired at the above step S111 (first abnormal state judging means). In the case that the comparison result of this step S112 becomes "non coincident", the microprocessor 10 judges at a step S113 as to whether or not an ignition system abnormal flag is set at a later step S124, and the drive operation is stopped at a step S125 (storage prohibiting means discussed-below. When the judgement result of the step S113 becomes "NO", the microprocessor 10 judges that an abnormal state happens to occur in the injection system, and then, at a step S114, an injection system abnormal flag with respect to the relevant cylinder is set to "H", while information related to this abnormal state is stored into the RAM memory employed in the microprocessor 10 (first abnormal state storing means). Next, at a step S115 subsequent to the step S114, drive outputting operations with respect to both the injection coil and the ignition coil as to the relevant cylinder are stopped (drive stopping means). Also, the warning/display apparatus 8 is driven at a step S116.

In such a case that the comparison result of the above step S112 is "non-coincident", in the case that the judgment result of the above step S113 becomes "YES", or in the case that the process operation defined at the above step S116 is ended, the microprocessor 10 sequentially updates and stores such information that the drive signals with respect to the ignition primary coils 5*a* to 5*d* are turned ON/OFF (ignition coil drive signal acquiring means) at a step S120. At a step S121 subsequent to this step S120, the microprocessor 10 sequentially updates and stores such information that the ignition primary coils 5*a* to 5*b* are energized and/or deenergized so as to be ON/OFF-driven into the RAM memory (ignition coil operation signal acquiring means). Next, at a step S122 subsequent to the step S121, the microprocessor 10 compares the drive signal acquired at the above step S120 with the operation signal acquired at the above step S121 (second abnormal state judging means). In the case that the comparison result of this step S122 becomes "non-coincident", the microprocessor 10 judges at a step S123 as to whether or not the injection system abnormal flag is set at the previous step S114, and the drive operation is stopped at a step S115 (storage prohibiting means discussed below). When the judgment result of the step S123 becomes "NO", the microprocessor 10 judges that an abnormal state happens to occur in the injection system, and then, at a step S124, the injection system abnormal flag with respect to the relevant cylinder is set to "H", while information related to this abnormal state is stored into the RAM memory employed in the microprocessor 10 (second abnormal state storing means). Next, at a step S125, drive outputting operations with respect to both the injection coil and the ignition coil as to the relevant cylinder are stopped. Also, the warning/display apparatus 8 is driven at a step S126. On the other and, in such a case that the comparison result of the above step S122 is "coincident", in the case that the judgment result of the above step S123 becomes "YES", or in the case that the process operation defined at the above step S126 is ended, the process operation is advanced to the end step S106, and then, is again advanced to the starting step S100.

Now, the function of the above-described step S113 will be again explained as follows: at the step S125, in such a case that although the abnormal state of the ignition system may directly constitute the cause, the driving operation of the injection coil is interconnectedly stopped, since the operation detection signal of the injection coil cannot be acquired which corresponds to the original drive timing of this injection coil, the automotive engine control apparatus is arranged in such a manner that while the injection system abnormal flag is not set in conjunction with this operation detection signal at the step S114, such information as to the interconnection stop is not stored in the RAM memory employed in the microprocessor 10 (storage prohibiting means). It should be noted that instead of the provision of the above-explained step S113, the supply of the drive pulse itself of the injection coil at the step S110 may be stopped. In the first embodiment of FIG. 1 and FIG. 2, the process operation at the step S110 is to produce the drive signal at the original drive timing irrespective of such a fact as to whether or not the drive prohibition is made.

In addition, the function of the above-described step S123 will be again explained. In the case that at the step S115, the abnormal state of the injection system may directly cause that the driving operation of the ignition coil is interconnectedly stopped since the operation detection signal of the ignition coil cannot be acquired which corresponds to the original drive timing of this ignition coil, the automotive engine control apparatus is arranged in such a manner that while the ignition system abnormal flag is not set in conjunction with this operation detection signal at the step S124, such information as to the interconnection stop is not stored in the RAM memory employed in the microprocessor 10 (storage prohibiting means). It should be noted that instead of the provision of the above-explained step S123, the supply of the drive pulse itself of the ignition coil at the step S120 may be stopped. In the first embodiment of FIG. 1 and FIG. 2, however, the process operation at the step S120 is to produce the drive signal at the original drive timing irrespective of such a fact as to whether or not the drive prohibition is made.

As previously described, in accordance with the automotive engine control apparatus of this first embodiment, since the turn-out drive (shunting drive) operation is carried out based upon the judgments of the abnormal states occurred in both the fuel injection system and the ignition coil system, the following problems: although the abnormal state happens to occur in the ignition coil system, the fuel is mistakenly injected, so that non-combustion gas exhausts; conversely, although the abnormal state happens to occur in the fuel injection system, the ignition coil is mistakenly driven, so that the electric energy is wasted; can be avoided by this automotive engine control apparatus. As a result, the turn-out drive operation can be carried out under stable condition in a high efficiency. In other words, the abnormal state in either the injection system or the ignition system is detected by both the first and second abnormal state judging means realized at the step S112 and the step S122. In the case that the abnormal state happens to occur in any one of the ignition system and the injection system, this automotive engine control apparatus is arranged in such a manner that the turn-out drive operation is carried out. In this turn-out drive operation, both the fuel injection and the ignition coil of the abnormal cylinder are stopped at the step S115 and the step S125. As a consequence, while the turn-out drive operation is carried out, the non-combustion gas does not exhaust, and the useless electric energy is not consumed, so that the stable turn-out drive operation can be carried out in the higher efficiency. Moreover, the abnormal state information is stored in the abnormal state storing means in discriminatable sorts of injection system/ignition system/cylinder system. Also, the storage prohibiting means realized at the steps S113 and S123 may prohibit to store the information as to the operation stop of one of the injection system and the ignition system, which is interconnected to the abnormal state of the other system. As a result, the stored malfunction information is caused only from any one of these injection/ignition systems, in which the abnormal state actually occurs. Such malfunction information as to the remaining system whose drive operation is prohibited in connection with the above-described abnormal state is not stored. Therefore, there is such an effect that the abnormal structural site can be easily founded out during maintenance/checking operation.

Second Embodiment

Figure 3:
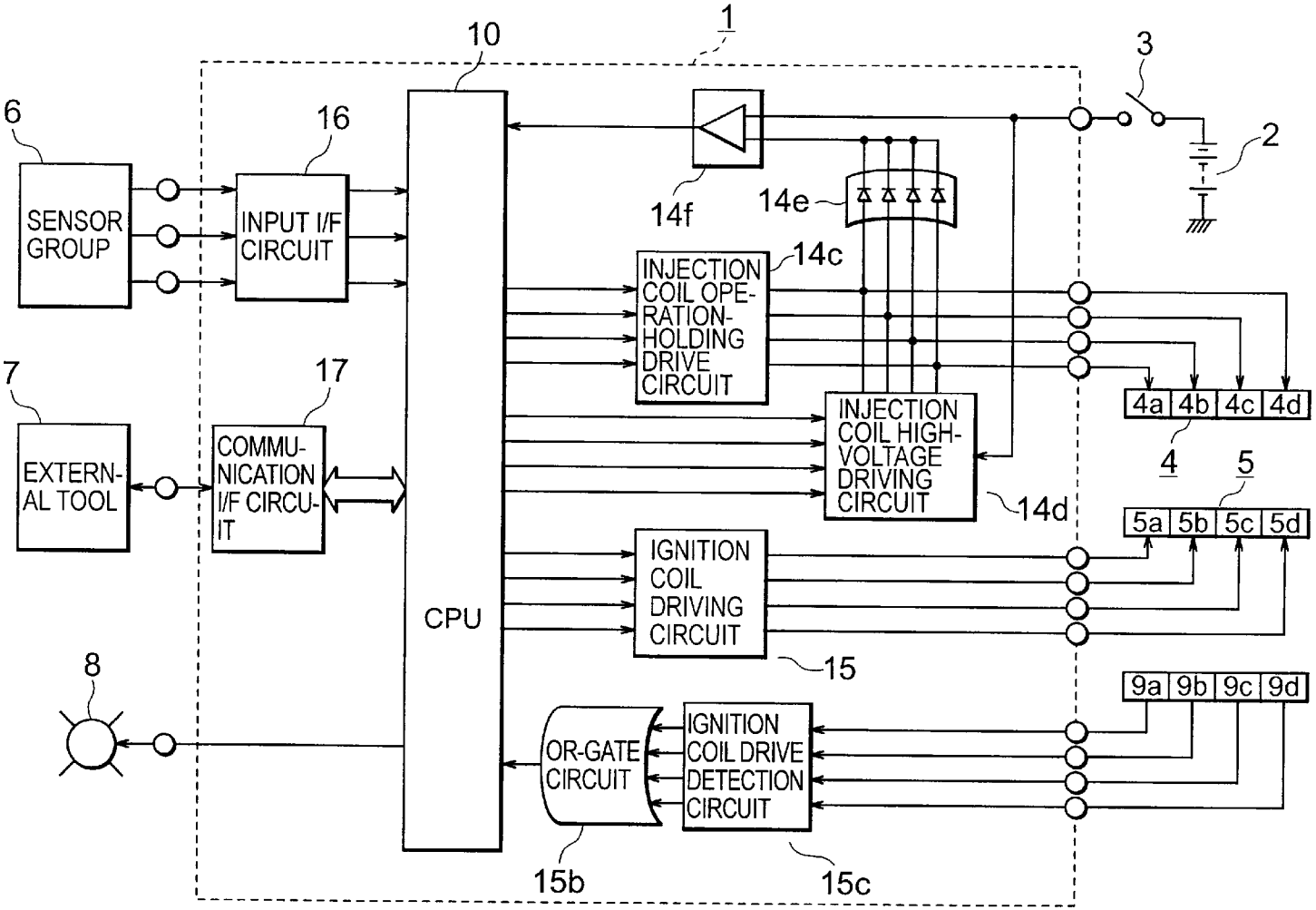
FIG. 3 is a structural diagram for schematically showing an automotive engine control apparatus according to a second embodiment of the present invention, and a peripheral construction of an internal combustion engine.

FIG. 3 is a diagram for representing an example of a configuration of an internal combustion engine on which an automotive engine control apparatus according to a second embodiment of the present invention is mounted. In this drawing, reference numbers 9*a*, 9*b*, 9*c* and 9*d* show ignition secondary coils, and reference numeral 14*c* indicates an injection coil operation holding drive circuit (the first switch element) to supply operation holding currents to the injection coils 4*a* to 4*d*. Also, reference numeral 14*d* represents an injection coil high-voltage drive circuit (the third switch element) to energize the injection coils 4*a* to 4*d* in a high speed, and reference numeral 14*e* shows an OR gate circuit which is constructed of a diode OR-gate circuit, and outputs a surge voltage produced in connection with the energized and/or deenergized operations for the injection coils 4*a* to 4*d*. Reference numeral 14*f* shows an injection coil drive detection circuit (the first detection circuit) which enters thereinto the surge voltage outputted from the OR-gate circuit 14*e* and the power supply voltage applied from the automotive battery 2 so as to perform comparison/judgement of these voltages. Also, reference numeral 15*c* indicates an ignition coil drive detection circuit (the second detection circuit). Since other structural elements of this automotive engine control apparatus are similar to those of the first embodiment mode, the same reference numerals are employed to denote those elements and thus, explanations thereof are omitted.

According to this second embodiment, referring to FIG. 3, different point of this second embodiment from the arrangements of FIG. 1 will be mainly explained. As a first different point of those shown in FIG. 3, the injection coils 4*a* to 4*d* are rapidly energized by the injection coil high-voltage drive circuit 14*d* for a short time period, and the operation holding current is supplied to these injection coils 4*a* to 4*d* by the injection coil operation holding drive circuit 14*c*. Also, the injection coil drive detection circuit 14*f* is configured by a comparator, and the OR-gate circuit constructed of the diode OR-gate circuit is connected to the inverting input terminal of this comparator. When a surge voltage produced in connection with the energized and/or deenergized operations of the injection coils 4*a* to 4*d* exceeds the power supply voltage, this injection coil drive detection circuit 14*f* supplies a detection signal having a logic level of "L" to the microprocessor 10. As a second different point of those shown in FIG. 3, the ignition coil drive detection circuit 15*c* is configured by the ignition current detection circuit for detecting ignition currents which are produced from the ignition secondary coils 9*a* to 9*d*.

Figure 4:
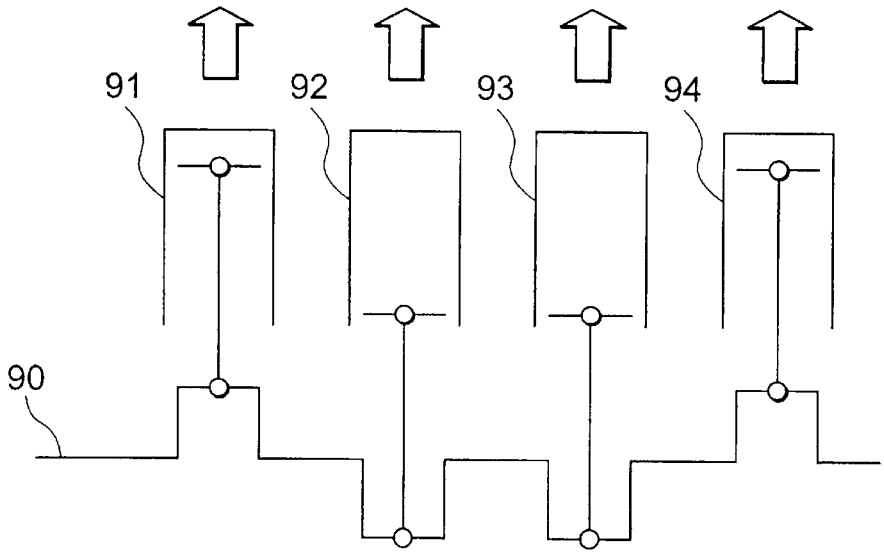
FIG. 4 illustratively shows a cylinder arrangement diagram used in the structure of FIG. 3.

FIG. 4 illustratively shows a cylinder arrangement diagram of the internal combustion indicated in FIG. 3. In FIG. 4, reference numeral 90 indicates a crank shaft of the engine. Reference numeral 91 shows a first cylinder in which a fuel injection is carried out by the above-described injection coil 4*a*, and in which an ignition operation is carried out for the injected fuel by the ignition primary coil 5*a*. Reference numeral 92 shows a second cylinder in which a fuel injection is carried out by the above-described injection coil 4*b*, and in which an ignition operation is carried out for the injected fuel by the ignition primary coil 5*b*. Reference numeral 93 shows a third cylinder in which a fuel injection is carried out by the above-described injection coil 4*c*, and in which an ignition operation is carried out for the injected fuel by the ignition primary coil 5*c*. Reference numeral 94 shows a fourth cylinder in which a fuel injection is carried out by the above-described injection coil 4*d*, and in which an ignition operation is carried out for the injected fuel by the ignition primary coil 5*d*. First, at a first time instant, both a compression operation and a fuel injection of the first cylinder are performed, and subsequently, an ignition operation is carried out for the injected fuel. At a second time instant subsequent to this first time instant, both a compression operation and a fuel injection of the third cylinder are performed, and subsequently, an ignition operation is carried out for the injected fuel. At a third time instant subsequent to this second time instant, both a compression operation and a fuel injection of the fourth cylinder are performed, and subsequently, an ignition operation is carried out for the injected fuel. At a fourth time instant subsequent to this third time instant, both a compression operation and a fuel injection as to the second cylinder are performed, and subsequently, an ignition operation is carried out with respect to the injected fuel. Subsequently, a similar engine operation is repeatedly carried out.

In the case of the above-described cylinder arrangement, when any one of the first cylinder 91 and the fourth cylinder 94 is brought into an abnormal state, while the operations of both the first cylinder 91 and the fourth cylinder 94 are stopped, the turn-out drive (shunting drive) operation is carried out by driving the second cylinder 92 and the third cylinder 93, resulting in a stable drive operation. Also, when any one of the second cylinder 92 and the third cylinder 93 is brought into an abnormal state, while the operations of both the second cylinder 92 and the third cylinder 93 are stopped, the turn-out drive (shunting drive) operation is carried out by driving the first cylinder 91 and the fourth cylinder 94, resulting in a stable drive operation. As a consequence, both the first cylinder 91 and the fourth cylinder 94 are classified as a first cylinder group, whereas both the second cylinder 92 and the third cylinder 93 are classified as a second cylinder group. As previously explained, the respective cylinders constitute the cylinder groups in combination with other cylinders which the injection timing is separated by the even-numbered timing.

Figure 5A:
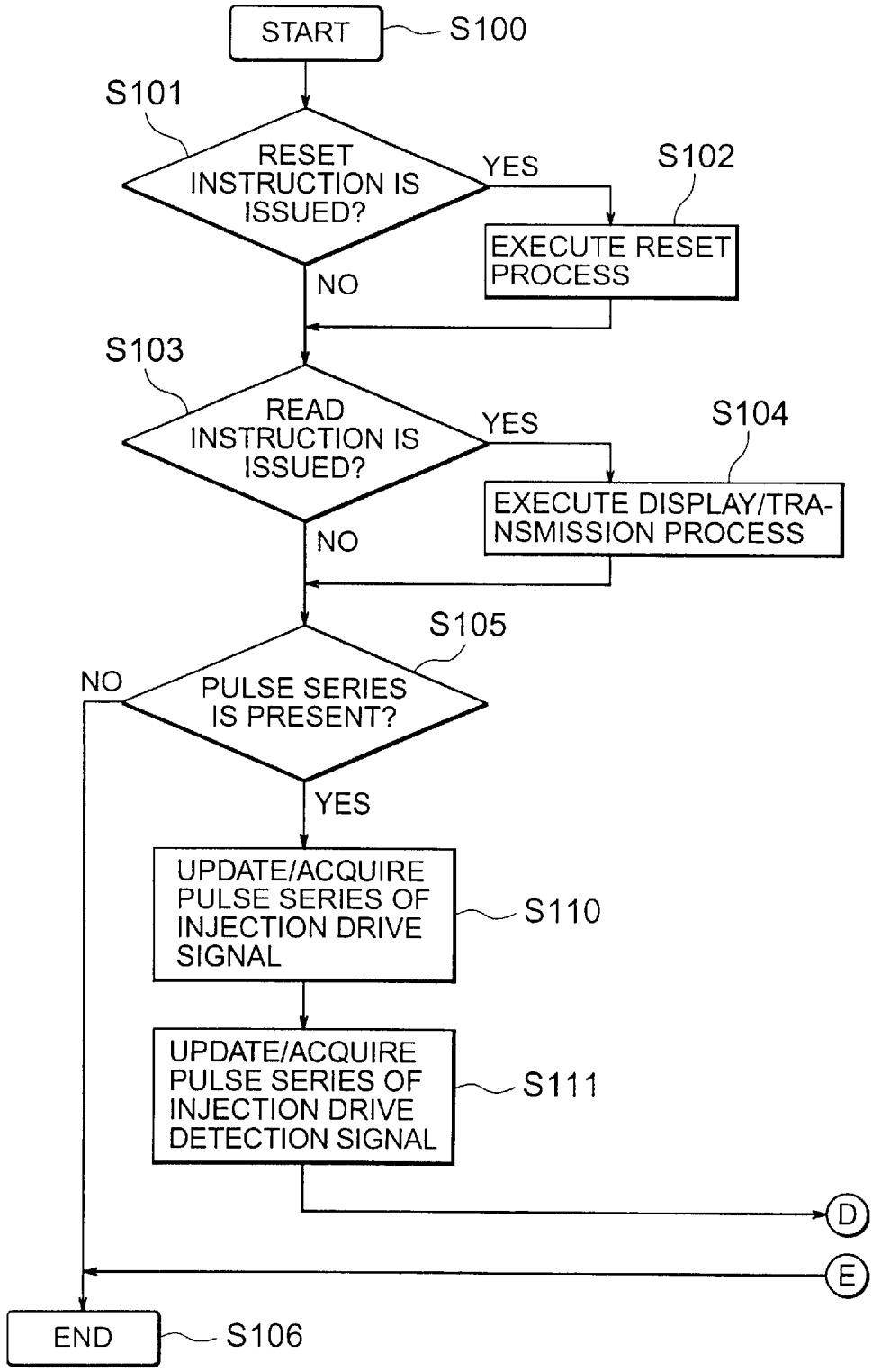
FIGS. 5A, 5B, 5C are flow charts for describing operations of the automotive engine control apparatus shown in FIG. 3.
Figure 5B:
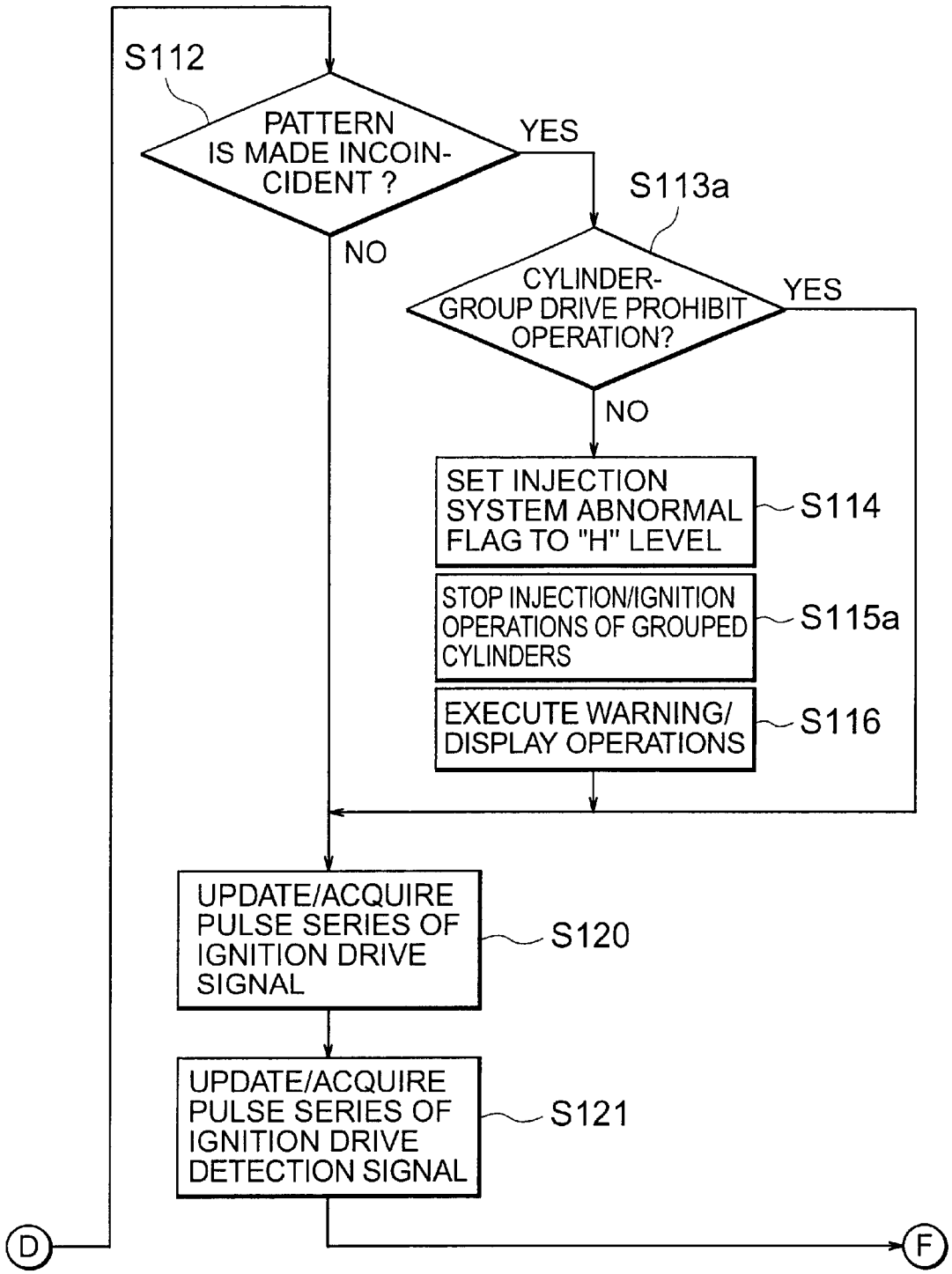
Figure 5C:
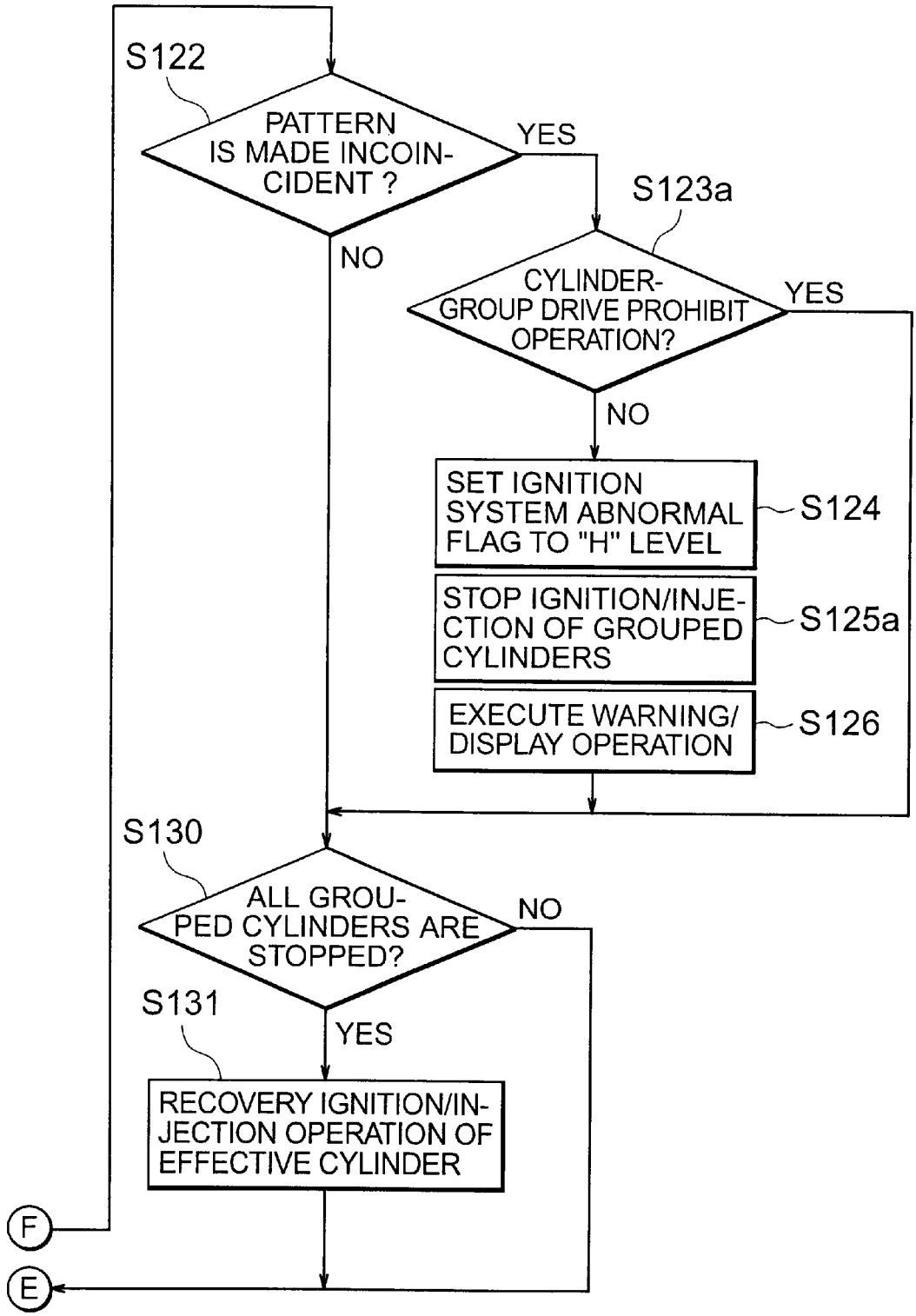

Next, operations of the automotive engine control apparatus will now be described. FIG. 5 is a flow chart to describe these operations of the arrangement of FIG. 3. In FIG. 5, different points from those of FIG. 2 will be mainly explained. It should be understood that FIG. 5 is featured as follows: that is, both a step S130 and a step S131 are newly added on the configuration of FIG. 2, and further, the above-described steps S113, S115, S123, and S125 shown in FIG. 2 are substituted by newly employed steps S113*a*, S115*a*, S123*a*, and S125*a*. These steps will now be explained.

That is, a process operation defined at the step S113*a* is executed in the case that the comparison result at the step S112 becomes "non-coincident", and corresponds to such a step that an ignition system abnormal flag is operated by a step S124 (will be discussed later), and a check is made as to whether or not the drive operation of the same cylinder group is stopped at the step S125*a*. The process operation defined at the step S114 is executed in the case that the judgement result of the step S113*a* becomes "NO", and corresponds to such a step for setting an injection system abnormal flag with respect to this cylinder, namely, which is basically similar to the process operation of the first embodiment. The step S115*a* is carried out subsequent to the above step S114, and corresponds to such a step that the drive outputs for injection coils and ignition coils of all of cylinders provided in the same cylinder group for this cylinder are stopped (cylinder group drive stopping means). The process operation defined at the step S116 is carried out subsequent to the above step S115*a*, and corresponds to a step for driving the warning/display apparatus 8, and is basically identical to that of the first embodiment. However, in this second embodiment, this process operation owns such a different point that the warning notices are synthesized with each other, while no distinction is made in the injection system/ignition system/cylinder system (warning/display synthesizing means).

A process operation defined at the step S123*a* is executed in the case that the comparison result at the step S122 becomes "non-coincident", and corresponds to such a step that an injection system abnormal flag is operated by the above-described step S114, and a check is made as to whether or not the drive operation of the same cylinder group is stopped at the step S115*a*. The process operation defined at the step S124 is executed in the case that the judgement result of the step S123*a* becomes "NO", and corresponds to such a step for setting an ignition system abnormal flag for this cylinder, namely, which is basically similar to the process operation of the first embodiment. The process operation defined at the step S125*a* is carried out subsequent to the above step S124, and corresponds to such a step that the drive outputs for injection coils and ignition coils of all of cylinders provided in the same cylinder group for this cylinder are stopped (cylinder group drive stopping means). The process operation defined at the step S126 is carried out subsequent to the above step S125*a*, and corresponds to a step for driving the warning/display apparatus 8, and which is basically identical to that of the first embodiment. However, in this second embodiment, this process operation owns such a different point that the warning notices are synthesized with each other, while no distinction is made in the injection system/ignition system/cylinder system (warning/display synthesizing means).

Now, the function of the above-described step S113*a* will be again explained. In the case that at the step S125*a*, the abnormal state of the ignition system of the specific cylinder may directly cause the driving operations of the ignition coil and the injection coil to be stopped interconnectedly. Since the operation detection signals of the injection coil and the injection coil which correspond to the original drive timing of these injection coil and ignition coil cannot be acquired, the automotive engine control apparatus is configured in such a manner that the injection system abnormal flag in conjunction with no acquisition of these operation detection signals is not set at the step S114 (interconnection storage prohibiting means).

It should be noted that instead of the provision of the above-described step S113*a*, the supply of these drive pulses themselves of the ignition coil and the injection coil at the steps S110 and S120 may be stopped. In this second embodiment, the process operations at the steps S110 and S120 are to produce the drive signals at the original drive timing regardless of a fact whether or not the drive prohibition is made.

Furthermore, the function of the above-described step S123*a* will be again explained as follows: that is, at the step S115*a*, in such a case that although the abnormal state of the injection system of the specific cylinder may directly constitute the cause, the driving operations of the injection coil and the ignition coil of the same cylinder group are interconnectedly stopped, since the operation detection signals of the injection coil and the injection coil cannot be acquired which correspond to the original drive timing of this injection coil, the automotive engine control apparatus is configured in such a manner that the ignition system abnormal flag in conjunction with no acquisition of these operation detection signals is not set at the step S124 (interconnection storage prohibiting means).

It should be noted that instead of the provision of the above-described step S123*a*, the supply of these drive pulses themselves of the ignition coil and the injection coil at the steps S110 and S120 may be stopped. In this embodiment of the drawing, the process operations at the steps S120 and S110 are to produce the drive signals at the original drive timing regardless of a fact whether or not the drive prohibition is made.

A process operation defined at S130 is executed in the case that the comparison result of the above-described step S122 becomes "coincident", in the case that the judgment result of the step S123*a* becomes "YES", or in such a case that the process operation defined at the step S126 is accomplished. This process operation of the step S130 corresponds to such a step for judging as to whether or not the drive operations of both the first cylinder group (namely, both first cylinder 91 and fourth cylinder 94), and also the second cylinder group (namely, both second cylinder 92 and third cylinder 93) need to be stopped. Also, a process operation defined at the above-explained step S131 is executed in such a case that the judgment result of the step S130 becomes "YES", and corresponds to such a step that both a fuel injection operation and an ignition operation are recovered for a valid cylinder. When the process operation of this step S131 is accomplished, or when the judgment result of the step S130 becomes "NO", the process operation is advanced to the end step S106, and subsequently, is advanced to the starting step S100.

It should also be noted that the process operation defined at the above-explained step S131 will be explained again. That is, for example, in the case that the fuel injection operation and the ignition operation of the fourth cylinder 94 belonging to the same cylinder group are interconnectedly stopped due to either the injection system abnormal state or the ignition system abnormal state of the first cylinder 91, for instance, when either the injection system abnormal state of the second cylinder 92 or the ignition system abnormal state of the second cylinder 92 occurs, originally, the interconnection operations between the fuel injection operation and the ignition operation of the third cylinder 93 of the same cylinder group are stopped, so that all of the operations of these cylinders are stopped. However, the process operation of this step S131 can perform the turn-out drive (shunting drive) operation functioning as the worst means in such a manner that the fuel injection operations and the ignition operations for the fourth cylinder 94 whose operation is interconnectedly stopped, and also for the third cylinder 93 whose operation is newly brought into the subject of the interconnection-stop (namely, recovery means).

It should also be noted in this second embodiment that the first detection circuit is constituted by, for example, an off-surge voltage detection circuit for the first switch element, whereas the second detection circuit is constituted by either the off-surge voltage detection circuit for the current interruption of the ignition primary coil which constitutes the ignition apparatus or the discharge current detection circuit of the ignition secondary coil. As a result, the off-surge voltage detection circuit can detect the shortcircuits, the disconnections, and the releases of the load coil, the switch element thereof, and also the wiring lines in a batch mode. Also, the discharge current detection circuit can also detect dirty damages of ignition plugs. Moreover, since these detection outputs of the off-surge voltage detection circuit and the discharge current detection circuit are OR-gated with each other, a number of input signals with respect to the microprocessor may be reduced.

As previously described, in accordance with this second embodiment, a similar effect to that of the above-explained first embodiment can be achieved. Moreover, while each cylinder constitutes a cylinder group in combination with such a cylinder whose injection timing is separated by plural sets of timings, a drive operation is stopped every cylinder group. In the case that all of the cylinder groups are brought into the drive stopping conditions, both the fuel injection operation and the ignition drive operation of cylinder where an abnormal state does not occur are recovered so as to perform the turn-out drive operation. As a result, the turn-out drive operation can be carried out in higher efficiency.

Third Embodiment

In the above-described first and second embodiments, the automotive engine control apparatus has been explained with employment of the four-cylinder type engine. However, the present invention is not limited to this four-cylinder type engine. For instance, even when a six-cylinder type engine or an eight-cylinder type engine is employed, in accordance with the present invention, while all of these cylinders are subdivided into a plurality of cylinder groups, the compression stages of which are not temporally located adjacent to each other, fuel injection/ignition operations may be stopped in the unit of this subdivided cylinder group.

Also, while a capacitor discharge type ignition apparatus may be employed as the ignition apparatus, a discharge timing of this capacitor may be controlled by a microprocessor. In this case, disconnections, shortcircuits, and the like of a load circuit may be detected by monitoring a charge voltage and a discharge voltage of this capacitor.

Furthermore, it is possible to check whether or not an injection coil is turned ON/OFF under normal condition by monitoring operation of a mechanical sensor which senses operation of a fuel injection valve.

As previously described in detail, the present invention is directed to such an automotive engine control apparatus for controlling an automotive engine equipped with injection coils capable of driving fuel injection electromagnetic valves for the respective cylinders of a multi-cylinder engine, and ignition apparatus provided with the respective cylinders, to perform ignition operations for injected fuel; comprising: control means for controlling an internal operation of the automotive engine control apparatus; a first switch element for sequentially driving the respective injection coils in response to a pulse series of an ignition drive signal produced by the control means; a first detection circuit to detect that at least the injection coils are turned ON/OFF; first abnormal state judging means for comparing a detection signal derived from the first detection circuit with the injection drive signal in order to judge whether or not said injection coils are operated under normal state for each of the cylinders; first abnormal state storage means for storing thereinto a judgment result obtained by the first abnormal state judging means with respect to each of the cylinders; a second switch element for sequentially driving the respective ignition apparatus in response to a pulse series of an ignition drive signal produced by the control means; a second detection circuit to detect that at least the respective ignition apparatus are turned ON/OFF; second abnormal state judging means for comparing a detection signal derived from the second detection circuit with the ignition drive signal in order to judge whether or not the ignition apparatus is operated under normal state with respect to each of the cylinders; second abnormal state storage means for storing thereinto a judgment result obtained by the second abnormal state judging means for each of the cylinders; drive stopping means for stopping both the fuel injection operation and the ignition drive operation such a cylinder operated under abnormal state, which is stored into any one of the first and second abnormal state storage means; and storage prohibiting means operated in such a manner that when any one of the first and second abnormal state storage means stores thereinto the judgment result of the cylinder operated under abnormal state, the other of the first and second abnormal state storage means is prohibited to store thereinto the judgment result. As a consequence, since the turn-out drive operation can be carried out based upon the abnormal state judgments of both the injection system and the ignition system, the ejection of the non-combustion gas and the consumption of the useless electric energy can be suppressed during the turn-out drive operation, and further, the stable turn-out drive operation can be carried out in the higher efficiency. Moreover, when one cylinder system whose drive operation is interconnectedly stopped in conjunction with the other cylinder system, this information is not stored in the abnormal state storage means by the storage prohibiting means. As a result, only such information related to the cylinder system in which the abnormal state actually occurs may be stored in the abnormal state storage means, and therefore, the abnormal portion may be easily found out during the maintenance/checking operation.

Also, the present invention is directed to such an automotive engine control apparatus for controlling an automotive engine equipped with injection coils capable of driving fuel injection electromagnetic valves with respect to the respective cylinders of a multi-cylinder engine, and ignition apparatus provided with the respective cylinders to perform ignition operations with respect to injected fuel, wherein: each of the cylinders constitutes a cylinder group in conjunction with another cylinder thereof, and the injection timing of which is separated by even-numbered timing from the injection timing of the first-mentioned cylinder; and the automotive engine control apparatus is comprised of: control means for controlling an internal operation of the automotive engine control apparatus; a first switch element for sequentially driving the respective injection coils in response to a pulse series of an ignition drive signal produced by the control means; a first detection circuit to detect that at least the injection coils are turned ON/OFF; first abnormal state judging means for comparing a detection signal derived from the first detection circuit with the injection drive signal in order to judge whether or not said injection coils are operated under normal state with respect to each of the cylinders; first abnormal state storage means for storing thereinto a judgment result obtained by the first abnormal state judging means for each of the cylinders; a second switch element for sequentially driving the respective ignition apparatus in response to a pulse series of an ignition drive signal produced by the control means; a second detection circuit for detecting that at least the respective ignition apparatus are turned ON/OFF; second abnormal state judging means for comparing a detection signal derived from the second detection circuit with the ignition drive signal in order to judge as to whether or not the ignition apparatus is operated under normal state with respect to each of the cylinders; second abnormal state storage means for storing thereinto a judgment result obtained by the second abnormal state judging means with respect to each of the cylinders; and cylinder group drive stopping means for stopping both fuel injection operations and ignition operations related to a cylinder operated under abnormal state which is stored into any one of the first and second abnormal state storage means, and also related to all of other cylinders which constitute a cylinder group in conjunction with the cylinder operated under abnormal state. As a consequence, there are no the exhaustion of non-combustion gas and the consumption of wasted useless electric energy during the turn-out drive operation, the turn-out drive operation can be carried out under stable condition.

Also, since the automotive engine control apparatus is further comprised of recovery means for causing both the fuel injection operation and the ignition drive operation to become active for such a cylinder whose information is not stored in the first and second abnormal state storage means in the case that the plural cylinder groups are stopped by the cylinder group drive stopping means, the turn-out drive operation can be carried out as the worst means.

Also, the automotive engine control apparatus is further comprised of: interconnection storage prohibiting means prohibits, in such a case that any one of the first and second abnormal state storage means stores thereinto the judgment result of the cylinder operated under abnormal state, such operations that the other of the first and second abnormal state storage means stores thereinto the judgment result, and also judgment results related to all of other cylinders which constitute a cylinder group in conjunction with the cylinder operated under abnormal state are stored into both the first and second abnormal state storage means. As a consequence, the exhaustion of non-combustion gas and the consumption of wasted electric energy, during the turn-out drive operation, can be suppressed, therefore, the turn-out drive operation can easily find out abnormal portions when the maintenance/checking operation is carried out.

Also, the first detecting circuit is an off-surge voltage detecting circuit with respect to the first switching element provided for the injection coil. As a result, the simple off-surge voltage detection circuit can detect the shortcircuits, the disconnections, and the releases of the load coils, the switch elements thereof, and also the wiring lines thereof in a batch mode, and also, can reduce a number of input signals with respect to the control means.

Also, the ignition apparatus includes an ignition primary coil; the second detection circuit is an off-surge voltage detection circuit to detect a current interrupt of the ignition primary coil; and the detection signal is supplied to the control means via an OR-gate circuit provided between the off-surge voltage circuit and the control means. As a result, the off-surge voltage detection circuit can detect the shortcircuits, the disconnections, and the releases of the load coils, the switch elements thereof, and also the wiring lines thereof in a batch mode. Also, the discharge current detection circuit can also detect dirty damages of ignition plugs. Moreover, since these detection outputs of the off-surge voltage detection circuit and the discharge current detection circuit are OR-gated with each other, a number of input signals with respect to the control means may be reduced.

Also, the ignition apparatus includes an ignition secondary coil; the second detection circuit is a discharge current detection circuit for the ignition secondary coil; and the detection signal is supplied to the control means via an OR-gate circuit provided between the discharge current detection circuit and the control means. As a result, the off-surge detection circuit can detect the shortcircuits, the disconnections, and the releases of the load coils, the switch elements thereof, and also the wiring lines thereof in a batch mode. Also, the discharge current detection circuit can also detect dirty damages of ignition plugs. Moreover, since these detection outputs of the off-surge voltage detection circuit and the discharge current detection circuit are OR-gated with each other, a number of input signals for the control means may be reduced.

Also, the automotive engine control apparatus is further comprised of a warning/display apparatus to notify the abnormal state in the case that any one of the first abnormal state storage means and the second abnormal state storage means stores thereinto the judgment result of the cylinder operated under abnormal state, so that the vehicle driver can immediately sense the abnormal state.

Also, the automotive engine control apparatus is further comprised of warning/display synthesizing means for issuing such a notification which does not discriminate the abnormal state occurred in an injection system/ignition system/cylinder system from each other in the case that any one of the first and second abnormal state storage means stores thereinto the judgment result of the cylinder operated under abnormal state; and the warning/display apparatus is operated in response to a signal supplied from the warning/display synthesizing means. As a consequence, the safety characteristic with respect to the drive operation can be improved.

Also, the automotive engine control apparatus is further comprised of a communication interface circuit to communicate with a predetermined external tool provided outside the automotive engine control apparatus; display/transmission means for transmitting/displaying malfunction information to/on the external tool; and reset means for initializing the storage contents of the first and second abnormal state storage means by way of the external tool. The control means is combined with the external tool, and thus, the malfunction information is read/displayed in accordance with the discriminated sorts of the injection system/ignition system/cylinder system. Accordingly, there are such advantages that the maintenance/checking operation can be easily carried out, and further, the abnormal state storage information can be simply initialized.

What is claimed is:

1. An automotive engine control apparatus for controlling an automotive engine including injection coils capable of driving fuel injection electromagnetic valves with respect to the respective cylinders of a multi-cylinder engine, and ignition apparatuses provided with the respective cylinders, for performing ignition operations with respect to injected fuel comprising:

control means for controlling an internal operation of the automotive engine control apparatus;

a first switch element for sequentially driving said respective injection coils in response to a pulse series of an ignition drive signal generated by said control means;

a first detection circuit for detecting that at least said injection coils are turned ON/OFF;

first abnormal state judging means for comparing a detection signal derived from said first detection circuit with said injection drive signal in order to judge whether or not said injection coils are operated under the normal state with respect to each of said cylinders;

first abnormal state storage means for storing thereinto a judgment result obtained by said first abnormal state judging means with respect to each of said cylinders;

a second switch element for sequentially driving said respective ignition apparatuses in response to a pulse series of an ignition drive signal generated by said control means;

a second detection circuit for detecting that at least said respective ignition apparatuses are turned ON/OFF;

second abnormal state judging means for comparing a detection signal derived from said second detection circuit with said ignition drive signal to judge whether or not the ignition apparatuses are operated under the normal state with respect to each of said cylinders;

second abnormal state storage means for storing thereinto a judgment result obtained by said second abnormal state judging means with respect to each of said cylinders;

drive stopping means for stopping both the fuel injection operation and the ignition drive operation as to a cylinder operated under the abnormal state, which is stored into any one of said first and said second abnormal state storage means; and storage prohibiting means operated in such a manner that when any one of said first and said second abnormal state storage means stores thereinto the judgment result of said cylinder operated under the abnormal state, the other of said first and said second abnormal state storage means is prohibited from storing thereinto said judgment result.

2. An automotive engine control apparatus as claimed in claim 1 wherein:

said first detection circuit comprises an off-surge voltage detection circuit used for said first switch element provided with respect to said injection coils; and said detection signal is supplied to said control means via an OR-gate circuit employed between said off-surge voltage detection circuit and said control means.

3. An automotive engine control apparatus as claimed in claim 1 wherein:

each of said ignition apparatuses includes an ignition primary coil;

said second detection circuit is an off-surge voltage detection circuit for detecting a current interrupt of said ignition primary coils; and said detection signal is supplied to said control means via an OR-gate circuit provided between said off-surge voltage detection circuit and said control means.

4. An automotive engine control apparatus as claimed in claim 1 wherein:

each of said ignition apparatuses includes an ignition secondary coil;

said second detection circuit is a discharge current detection circuit for detecting a discharge current of said ignition secondary coils; and said detection signal is supplied to said control means via an OR-gate circuit provided between said discharge current detection circuit and said control means.

5. An automotive engine control apparatus as claimed in claim 1, further comprising:

a warning/display apparatus for notifying the abnormal state in the case where any one of said first abnormal state storage means and said second abnormal state storage means stores thereinto the judgment result of said cylinder operated under the abnormal state.

6. An automotive engine control apparatus as claimed in claim 5, further comprising:

warning/display synthesizing means for issuing a notification that an abnormal state has occurred, without discriminating a cause of the abnormal state of an injection system, an ignition system, and a cylinder system, where any one of said first and said second abnormal state storage means stores thereinto the judgment result of said cylinder operated under the abnormal state; and wherein said warning/display apparatus is operated in response to a signal supplied from said warning/display synthesizing means.

7. An automotive engine control apparatus as claimed in claim 1, further comprising:

a communication interface circuit for communicating with a predetermined external tool provided outside of said automotive engine control apparatus;

display/transmission means for transmitting/displaying malfunction information to/on said external tool; and reset means for initializing the storage contents of said first and second abnormal state storage means by means of said external tool.

* * * * *